United States Patent [19]

Stumbaugh

[11] 4,373,736

[45] Feb. 15, 1983

[54] TWO WHEEL ROLLER SKATE

[76] Inventor: Leo F. Stumbaugh, 6780 SE. 125th St., Box 24, Belleview, Fla. 32620

[21] Appl. No.: 219,267

[22] Filed: Dec. 22, 1980

[51] Int. Cl.[3] ..... A63C 17/02

[52] U.S. Cl. ..... 280/11.23; 280/11.27

[58] Field of Search ..... 280/11.23, 11.25, 11.28, 280/11.22, 11.27

[56] References Cited

U.S. PATENT DOCUMENTS

| | | | |
|---|---|---|---|
| 259,708 | 6/1882 | Neely | 280/11.23 |
| 1,043,958 | 11/1912 | Mollinger | 280/11.23 |
| 1,640,134 | 8/1927 | Salberg | 280/11.28 X |
| 1,772,333 | 8/1930 | Woelfer | 280/11.23 |
| 2,204,280 | 6/1940 | Meister | 280/11.23 |
| 2,552,987 | 5/1951 | Loertz, Jr. | 280/11.23 X |
| 4,047,727 | 9/1977 | Holladay et al. | 280/11.28 X |
| 4,278,264 | 7/1981 | Lenz | 280/11.28 |
| 4,295,655 | 10/1981 | Landay et al. | 280/11.28 X |

FOREIGN PATENT DOCUMENTS

| | | | |
|---|---|---|---|
| 410240 | 5/1910 | France | 280/11.23 |

*Primary Examiner*—Robert R. Song
*Assistant Examiner*—Michael Mar
*Attorney, Agent, or Firm*—Cohn, Powell & Hind

[57] ABSTRACT

A two wheel roller skate including a shoe having a sole, a front wheel carried on a front axle and a rear wheel carried on a rear axle. The skate includes a pair of axle forks each of the axle forks having opposed side portions which receive the axle, and a transverse portion which interconnects the side portion at one end of the axle forks. Each axle fork side portion includes a generally inclined portion engageable with the shoe sole and a generally horizontal portion connected to the transverse portion. The sole includes opposed side slots which receive the unconnected ends of the side portions and a fastener attaches the transverse portion of the axle forks to the sole, the axle fork side portions and the transverse portion fastener providing a three-point connected to the roller skate. The axle forks can be readily connected and disconnected from the shoe sole for replacement of the wheels with wheels having a rounded bearing surface.

2 Claims, 4 Drawing Figures

TWO WHEEL ROLLER SKATE

BACKGROUND OF THE INVENTION

This invention relates in general to a roller skate and particularly to a two wheel roller skate in which axle forks carry the wheels.

Two wheel roller skates are known in the art, for example U.S. Pat. No. 2,204,280 discloses a two wheel roller skate in which axle forks are pivotally attached to the skate sole plate. Another two-wheel skate having a coiled compression spring for controlling floating action of the skate forks is disclosed in U.S. Pat. No. 2,552,987. In a two wheel roller skate it is important that the fork be securely attached to the skate sole plate in order to provide the support required for use by a roller skater, particularly in view of the additional weight carried by each wheel, as opposed to a four wheel skate. However, it is also important that the axle fork be easily attachable to and detachable from the roller skake sole in order to facilitate assembly and interchangeability of the axle fork and wheel carried by the axle fork. This combination of features is not disclosed in the known prior art.

SUMMARY OF THE INVENTION

This two wheel roller skate provides an axle fork which is both securely attachable to the sole and readily interchangeable with another axle fork.

The roller skate includes a shoe having a sole, a front wheel carried on a front axle and a rear wheel carried on a rear axle. A pair of axle forks are included, each axle fork having opposed ends, one of the axle forks carrying the front axle and the other axle fork carrying the rear axle. Each axle fork includes opposed side portions which receive the axles in bearing relation and a transverse portion which interconnects the side portions at at least one end of the axle forks. The transverse portion includes fastener means attaching one end of the axle fork to the sole, the other end of the axle fork being attached to the sole in bearing relation.

In one aspect of the invention the one axle fork is identical to and interchangeable with the other axle fork. In another aspect of the invention the axle fork side portions and transverse portion fastener means provide a three-point connection to the roller skate. In yet another aspect of the invention the axle fork side portions define a V-shaped configuration. In still another aspect of the invention the axle fork side portions each include a generally inclined portion engageable with the shoe sole and a generally horizontal portion connected to the transverse portion.

In one aspect of the invention the fastener means includes bolt means operatively engaging the axle forks and are threadably received by the sole for attachment of the transverse intermediate portion to the sole. In another aspect, flexible cushion members are interposed between the sole and the transverse portion.

In one aspect of the invention, the sole includes pairs of opposed side slots which receive the unconnected ends of the side portions in bearing relation. In another aspect, the side portion unconnected ends include first portions received by the sole slots and bearing margins engaging the sole.

In yet another aspect of the invention the wheels have a rounded bearing surface. In still another aspect of the invention the sole is contoured thereby providing wheel recesses.

DESCRIPTION OF THE PREFERRED EMBODIMENT

Figure 1:
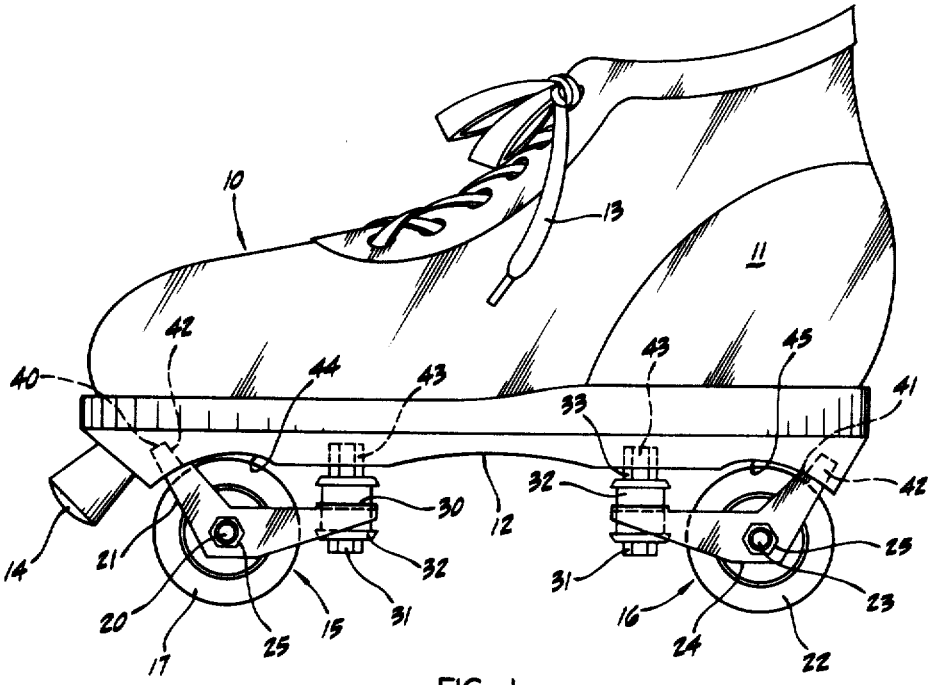
FIG. 1 is a side elevational view of the two wheel roller skate.
Figure 2:
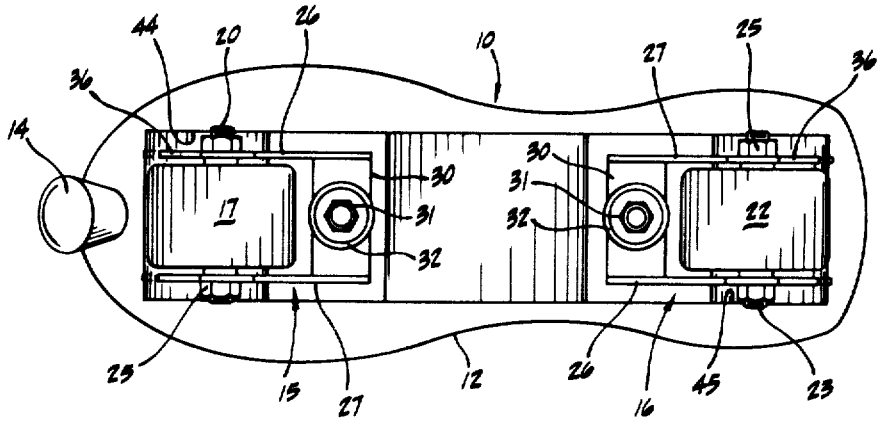
FIG. 2 is a bottom plan view thereof.

Referring now by characters of reference to the drawings and first to FIG. 1, it will be understood that the two-wheel roller skate, generally indicated by 10, includes a shoe 11 having a molded sole 12 which, in the preferred embodiment, is integrally formed with the sole of the shoe 11. A lace 13 is provided for fastening the shoe 11 and a conventional toe stop 14 is attached to the sole 12.

The skate 10 includes front and rear wheel assemblies 15 and 16. As shown in FIG. 1, the front wheel assembly 15 includes a wheel 17 carried on a front axle 20, said axle being mounted to an axle fork 21. The rear wheel assembly 16 includes a wheel 22 carried on a rear axle 23, said rear axle 23 being mounted to a rear axle fork 24. Nuts 25 attach the axles 20 and 23 to their respective front and rear axle forks 21 and 24.

Figure 3:
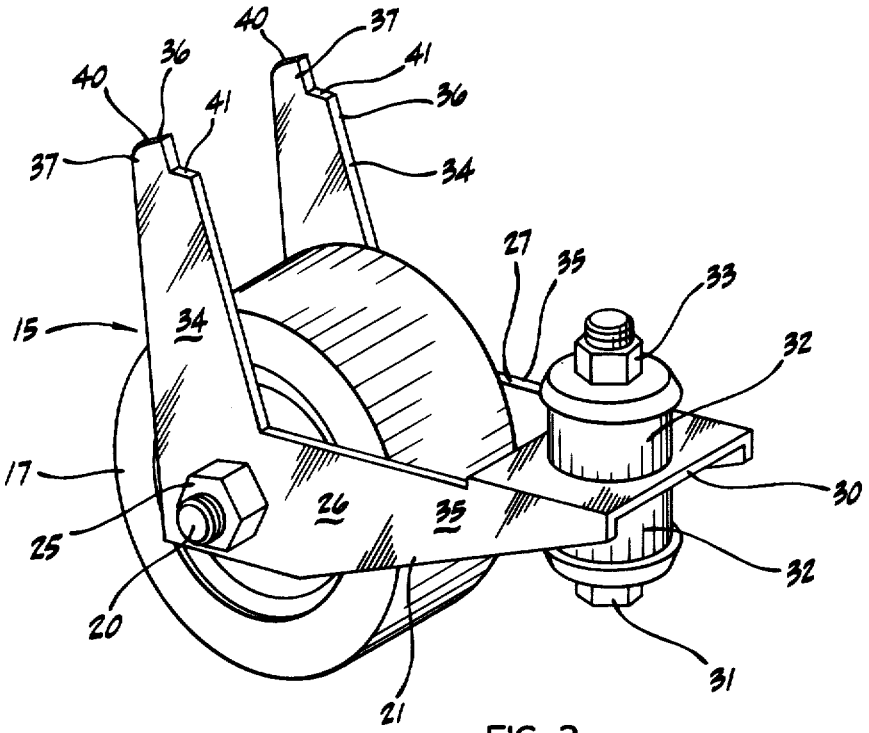
FIG. 3 is an enlarged perspective view of an axle fork and wheel.

Referring now to FIG. 3, in which the wheel assembly 15 is shown in greater detail, it will be seen that the axle fork 21 includes opposed side portions 26 and 27 and a transverse portion 30 which interconnects the side portions 26 and 27 at one end of the axle fork 21. The opposed side portions 26 and 27 receive the axle 20. Fastener means connecting the transverse portion 30 to the sole 12 are provided by a bolt 31 which operatively engages the transverse portion 30 through flexible cushion members 32 which are retained on the bolt 31 by the lock nut 33.

The axle fork side portions 26 and 27 each include corresponding, generally inclined portions 34 and generally horizontal portions 35. The inclined portions 34 and horizontal portions 35 defining V-shaped configurations.

The other end of the axle fork 21 includes unconnected ends 36. Each unconnected end 36 includes a protruding portion 37 having an upper margin 40 and a bearing margin 41.

Referring to FIGS. 1 and 3, it will be seen that the protruding portions 37 are selectively received by slots 42 in the sole 12. The upper margins 40 engage the sole 12 in bearing relation within the slots 42 while the bearing margins 41 engage the sole 12 in bearing relation without the slots 42. Nuts 43 are embedded within the sole 12 providing threaded sockets for receiving the bolts 31. The unconnected ends 36 of the fork 21 engage the sole 12 forward of the axle 20 while the bolt 31 engages the sole 12 rearward of the axle 20. The unconnected ends 36 are received in the spaced slots 42, and the bolt 31 is received in the embedded nut 43 thereby providing a three-point attachment to the sole 12. The sole 12 is contoured thereby providing wheel recesses 44 and 45 which permit a shorter distance to be maintained between the sole 12 and the center of rotation of the wheel 17.

It will be understood that in the preferred embodiment the front and rear wheel assemblies 15 and 16 are identical and characters of reference utilized for description of various parts of the axle fork 21 are used to indicate the corresponding parts of the axle fork 24. The only essential difference between the axle fork 21 and 24 is that the axle fork 24 is reversed with the unconnected ends 36 being rearward and the associated bolt 31 being forward of the axle 23.

Figure 4:
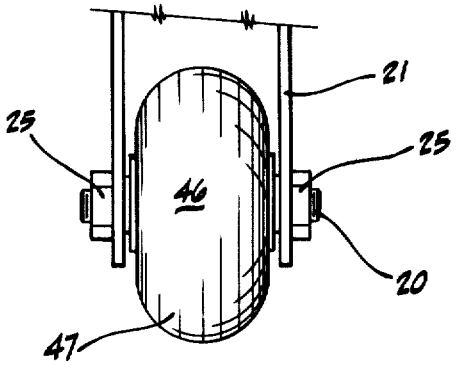
FIG. 4 is a fragmentary elevational view of a modified wheel attached to an axle fork.

Referring now to FIG. 4, a modified wheel 46 is shown attached to an axle fork 21. The wheel 46 has a rounded bearing surface 47. The rounded bearing surface 47 allows the wheel 46 to engage a flat surface in a smooth transition as the angle of the wheel 46 is tilted from the vertical position shown in FIG. 4.

It is thought that the structural features and functional advantages of the two wheel roller skate 10 have become apparent from the foregoing description of parts, but for completeness of disclosure a brief description of the use of the roller skate will be given.

The roller skate 10 is laced to the foot of the user in a conventional manner. As is customary, two skates 10 are normally used, one for the left foot and the other for the right foot.

The performance of the skate 10 is determined by whether a conventional wheel 17 is utilized or whether the wheel 46 with its curved bearing surface 47 is utilized. The wheels 17 and 46 are readily interchangeable. Each of the wheels 17 and 46 can be mounted in its own axle fork 21 and the wheel assemblies can be readily removed or attached to the skate 10 by the bolt 31. The protruding portions 37 are retained within slots 42 by the attachment of the bolt 31 to the sole nut 43, no other attachment means is necessary to fix the protruding portions 37 to the sole 12. Essentially, each of the wheel assemblies 15 and 16 is attached to the sole 12 by simply inserting portions 37 into associated slots 42, and swinging the axle fork so that the bolt 31 can be threaded into the embedded nut. Weight brought to bear on the protruding portion margins 40 and 41 will readily be transferred to the axle 20 and wheel 17.

Alternatively, the wheels 17 and 46 can be interchanged on individual axle fork 21 by removing the nuts 25 from the axle 21 for removing the wheel which is attached to the axle fork 21 replacing it with the other wheel. The same type of wheel will normally be used in the front and rear of the skate 10.

As will be readily apparent, the structural arrangement of parts of the wheel assemblies 15 and 16 allows for simple attachment and detachment of the axle forks 21 and 24 from the shoe sole 12 while providing a solid three-point connection for good mechanical support of the shoe 10 by the wheel 14. The sole contours 44 and 45 allow the inclined portions 34 of the axle forks 21 and 24 to be of shorter length than would be required if the sole 12 was flat. This shorter length provides greater stability.

I claim as my invention:

1. A two wheel roller skate, comprising:

(a) a shoe, (b) a sole attached to the shoe, (c) front and rear wheel assemblies, each assembly including a wheel, an axle carrying the wheel and an axle fork carrying the axle, the axle fork including:

1. opposed side portions receiving an associated axle in bearing relation, and having first interconnected ends and second unconnected ends, and
2. fastener means selectively operatively attaching said interconnected ends to said sole, the unconnected ends being received by said sole in bearing relation, (d) the sole including front and rear pairs of opposed side slots which receive the side portion unconnected ends in bearing relation, the side portion unconnected ends and fastener means providing a three-point connection to the sole, and (e) said side portion unconnected ends including portions received by the sole slots and bearing margins directly engaging the bottom surface of the sole.

2. A two wheel roller skate as defined in claim 1, in which:

(f) the sole is contoured for providing wheel recesses, (g) the sole includes threaded sockets, and (h) the fastener means includes bolts threadably receivable by the threaded sockets.

* * * * *